US005966918A

United States Patent [19]

Kino et al.

[11] Patent Number: 5,966,918

[45] Date of Patent: Oct. 19, 1999

[54] YARN FALSE TWISTING DEVICE

[75] Inventors: Yoshihiro Kino, Uji; Toshikazu Nishiyama, Nagaokakyo, both of Japan

[73] Assignee: Murata Kikai Kabushiki Kaisha, Kyoto 601, Japan

[21] Appl. No.: 09/035,346

[22] Filed: Mar. 5, 1998

[30] Foreign Application Priority Data

Mar. 7, 1997 [JP] Japan ..... 9-070666

[51] Int. Cl.[6] ..... D01H 7/46

[52] U.S. Cl. ..... 57/264; 57/334; 57/336

[58] Field of Search ..... 57/264, 284, 334, 57/336, 93, 100

[56] References Cited

U.S. PATENT DOCUMENTS

| | | | |
|---|---|---|---|
| 4,144,700 | 3/1979 | Takai et al. | 57/264 |
| 4,899,533 | 2/1990 | Schmitt et al. | 57/339 |
| 5,022,599 | 6/1991 | Nakade | 242/75.51 |

FOREIGN PATENT DOCUMENTS

| | | |
|---|---|---|
| 54-38635 | 3/1979 | Japan . |
| 6-184848 | 7/1994 | Japan . |

*Primary Examiner*—William Stryjewski
*Assistant Examiner*—Gina Silverio
*Attorney, Agent, or Firm*—Armstrong, Westerman, Hattori, McLeland & Naughton

[57] ABSTRACT

A yarn false twisting device in which two motors 30, 40 are installed separately for each of the drive shafts 30*a*, 40*a* of each false twist application element, and each motor is controlled by a control unit C in accordance with changes in the yarn tension. The installation of separate motors for each drive shaft of each false twist application element has enabled the elimination of complex power transmission mechanisms such as an endless belt or idler, making the yarn false twisting device more compact. Furthermore, each motor is controlled so as to rotate in mutually synchronic fashion according to changes in the yarn tension, improving the overall quality of false twisted yarn.

9 Claims, 5 Drawing Sheets

YARN FALSE TWISTING DEVICE

FIELD OF THE INVENTION

The present invention relates to a yarn false twisting device that sandwiches a yarn between a pair of crossed endless belts, provides twist to the yarn, and feeds the yarn forward.

BACKGROUND OF THE INVENTION

As illustrated in FIG. 5, a device of this type, as is known in the art, is so constructed that one endless belt 1 of a pair of crossed endless belts 1, 2, wherein a yarn y is sandwiched, is installed between pulleys 1*a*, 1*b*, that are positioned a specified distance apart, and the other endless belt 2 is likewise installed between pulleys 2*a*, 2*b* that are positioned a specified distance apart. One pulley 1*a* with which the endless belt 1 is engaged is connected to an output shaft 3*a* of a motor 3.

Furthermore, a toothed pulley 4 is connected to the said output shaft 3*a*. The other pulley 2*a* with which the endless belt 2 is engaged is connected to a shaft 5, and a toothed pulley 6 is also connected to the said shaft 5. To the toothed pulley 4 that is connected to the said toothed pulley 6 and the output shaft 3*a* of the motor 3, an endless timing belt 9, which is guided by idlers 7, 8, is installed. The thus constructed device works as follows; starting the motor 3 rotates the pulley 1*a* that is connected to the output shaft 3*a* of the motor 3 thereby the endless belt 1 that is installed between the pulleys 1*a*, 1*b* and the endless belt 2 that is installed between the pulleys 2*a*, 2*b* run through the toothed pulley 4, the endless timing belt 9 and the toothed pulley 6.

Additionally, the conventional yarn false twisting device is so constructed that, after the yarn y is sandwiched between the aforesaid pair of the endless belts 1, 2 and provided with false twist, its tension is detected by a tension detecting element t. When the tension of the yarn y is larger than a predetermined setting or range, a control unit c increases the rotation rate of the motor 3 in order to increase the travelling speeds of the endless belts 1, 2, thereby increasing the feed rate of the yarn y and decreasing the tension of the yarn y.

Similarly, when the tension of the yarn y is smaller than a predetermined setting or range, the control unit c decreases the rate of rotation of the motor 3 in order to decrease the travelling speeds of the endless belts 1, 2, thereby decreasing the feed rate of the yarn y and increasing the tension of the yarn y.

As the conventional yarn false twisting device described above is designed to run one of the pair of the endless belts 1, 2 by using such mediums as the toothed pulley 4, the endless timing belt 9 and the toothed pulley 6, it has a problem in that the power transmission mechanism from the motor 3 is complex, thereby causing the yarn false twisting device itself to become larger and the frequency of servicing to increase.

Furthermore, due to the above construction, it is difficult to change the cross angles of the endless belts 1, 2 by changing the angle of the output shaft 3*a* of the motor 3 and the shaft 5 of the pulley 2*a*, over which the endless belt 2 is installed.

The object of the present invention is to solve the above problems of the conventional yarn false twisting device, and to provide a yarn false twisting device with improved travelling speed controlling means of the endless belts in response to changes in yarn tension.

SUMMARY OF THE INVENTION

In order to achieve the aforesaid object, the present invention is equipped with drive motors that are connected separately to the respective driving shafts of a false twist application element, which gives false twist to yarn; a yarn tension detecting means that detects yarn tension; and controlling means that control the respective rotation rates of each of the said motors in accordance with the yarn tension detected.

The present invention is equipped with rotation detecting means that detect the respective rotation rates of each of said motors.

The present invention is equipped with controlling means that calculate the respective target rotation rates applicable to each of said motors in accordance with the yarn tension detected by the yarn tension detecting means, and then control each of said motors separately so that the rotation rates detected by the respective rotation detecting means are equal to the target rotation rates.

The present invention is equipped with a yarn breakage detecting means that detects the occurrence of yarn breakage. It is so constructed that the respective controlling means stop each of the said motors when yarn breakage is detected.

The present invention is equipped with load current detecting means that detect the respective load currents of each of said motors. It is so constructed that the yarn breakage detecting means detect the occurrence of the yarn breakage based on the respective load currents detected by the load current detecting means.

All of said motors are brushless motors.

All of said motors are inner rotor motors wherein a rotor is positioned opposite the inner side of a stator.

The said false twist application element is an endless belt that is so constructed that the yarn is sandwiched between one pair of crossed endless belts, and false twist is given to said yarn.

DETAILED DESCRIPTION OF THE PREFERRED EMBODIMENTS

Figure 1:
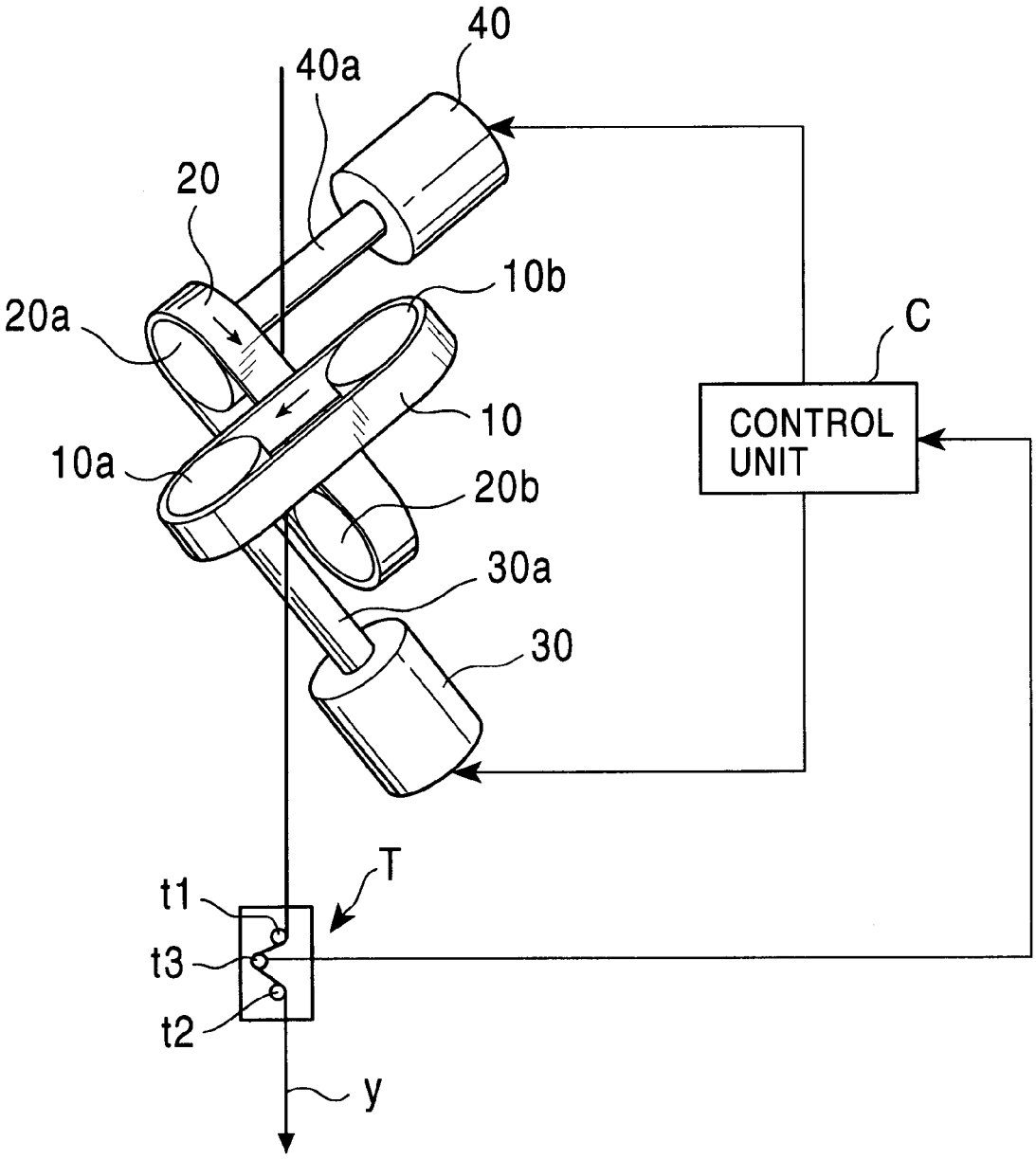
FIG. 1 is a perspective side view of a yarn false twisting device, including control blocks, of the present invention.

An embodiment example of the present invention is now described with reference to FIGS. 1~4.

The preferred embodiment described herein is illustrative and not restrictive unless the object of the present invention is neglected.

Numeral 10 refers to an endless belt that is installed between one pair of pulleys 10*a*, 10*b* that are positioned a specified distance apart. The pulley 10*a* is connected to an output shaft 30*a* of a motor 30. As a result, starting the motor 30 runs the endless belt 10 that is installed between the pulleys 10*a*, 10*b*.

Numeral 20 refers to another endless belt that is installed between one pair of pulleys 20*a*, 20*b* that are positioned a specified distance apart. The said pulley 20*a* is connected to an output shaft 40*a* of a motor 40, which differs from the motor 30 that operates the aforesaid endless belt 10. As a result, starting the motor 40 runs the endless belt 20 that is installed between the pulleys 20*a*, 20*b*.

A yarn y is sandwiched between the pair of the endless belts 10, 20 which are crossed and contact each other at a specified cross angle. The yarn y is then provided with false twist, and fed in the predetermined direction (downward in FIG. 1).

For the aforesaid motors 30, 40, a brushless motor consisting of a permanent magnet as the rotor that is connected to the output shafts 30*a*, 40*a* and having on armature winding as the stator that is positioned surrounding the said permanent magnet is used. Using such brushless motors helps simplify the maintenance control of the motors 30, 40. Additionally, the size of the motor 30, 40 is reduced, and in turn, the size of a yarn false twisting device can be reduced.

Figure 3:
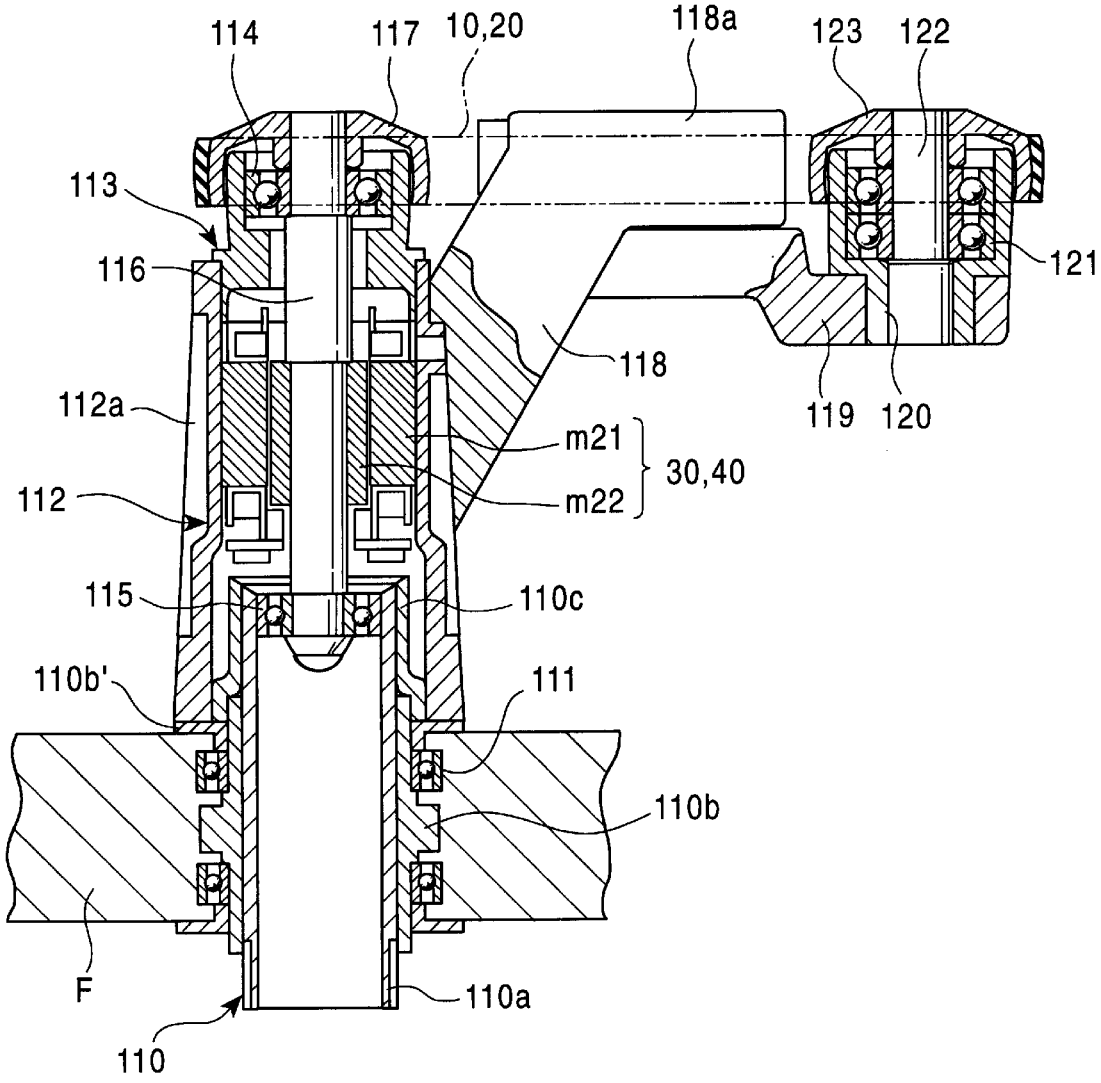
FIG. 3 is a front view, partly in cross section, of the false twist application element that makes up the yarn false twisting device of the present invention.

Referring to FIG. 3, the components that comprise the false twist application element, including a brushless motor, are explained in detail.

Numeral 110 refers to a base member consisting of an inner cylinder 110*a*, a first outer cylinder 110*b*, which is installed around the inner cylinder 110*a* and has bearings 111, and a second outer cylinder 110*c*, which is located the above first outer cylinder 110*b* and similarly installed around the inner cylinder 110*a*. The base member 110 is secured to a frame F through the bearings 111, which are installed on the aforesaid first outer cylinder 110*b*.

Numeral 112 refers to an intermediate member of cylindrical shape whose bottom part is secured to a flange 110*b*' of the first outer cylinder 110*b* with an appropriate removable fastener such as screws or bolts. On the outer area of the intermediate member 112, two or more fins 112*a* are installed along the axial direction of the intermediate member 112.

Numeral 113 refers to a cylindrically shaped top member that is secured to the top and inside of the intermediate member 112 with an appropriate removable fastener such as screws or bolts.

In addition, a rotation axle 116 is connected to a bearing 114, which is installed inside the top member 113, and to a bearing 115 which is installed at the top and inside of the inner cylinder 110*a* of the base member 110. Numeral 117 refers to first pulley which is connected to the top end of the rotation axle 116.

Reference character m21 refers to two or more driving coil stators that are positioned inside the cylindrical intermediate member 112 at proper intervals.

Reference character m22 refers to a rotor magnet that is positioned inside the driving coil stator m21 and is attached to the rotation axle 116. An inner rotor brushless motor 30, 40 consists of the driving coil stator m21 that is attached to the aforesaid intermediate member 112 and the rotor magnet m22 that is attached to the rotation axle 116.

Numeral 118 refers to an arm that is either integrated with, or attached, to the intermediate member 112, and a supporting frame 118*a* is formed at the free end of the arm 118. Numeral 119 refers to a second pulley supporting arm which is attached to the supporting frame 118*a* of the arm 118, and a driven rotation axle 122 which is parallel with the rotation axle 116, is installed on a bearing 121 which, in turn, is built into a bearing frame 120 that is connected to a second pulley supporting arm 119. A second pulley 123 is connected to the driven rotation axle 122. In addition, endless belts 10, 20 are installed, as the false twist application element, between the first pulley 117 which is connected to the top end of the aforesaid rotation axle 116 and the second pulley 123 which is connected to the driven rotation axle 122.

The false twist application element is so constructed that running current from the driving circuit sequentially into two or more driving coils m21, which are placed inside the cylindrical intermediate member 112, generates a rotating magnetic field around the rotor magnet m22, causing the rotor magnet m22 and consequently the rotation axle, to rotate. As a result, the first pulley 117, which is connected to the rotation axle 116, rotates, making the endless belts 10, 20, that are installed between the first pulley 117, which is attached to the rotation axle 116, and the second pulley 123, which is attached to the driven rotation axle 122, travel in the predetermined direction.

Reference letter T refers to a tension detector similar to the tension detecting element t (yarn tension detecting means) of the conventional yarn false twisting device described above. In this embodiment example, it is so constructed that changes in the tension and loosening of the yarn y are detected at one place by movements of a mobile guide t3 that is placed between one pair of stationary guides t1, t2. Of course, various conventional tension detectors can also be used.

Letter C refers to a computer integrated control unit (controlling means). This control unit incorporates a judgement means for determining whether the tension of yarn y detected by the tension detector T is inside or outside the predetermined setting range, and a motor drive controlling means for controlling exciting current to be supplied to the armature winding of one pair of the motors 30, 40 based on the determination of the said jugement means.

It is so constructed that one pair of the motors 30, 40 that make one pair of the endless belts 10, 20 travel are controlled by the judgement means and the motor drive controlling means, both of which are incorporated in one control unit C, and the pair of the motors 30, 40 rotate in synchronization with each other.

If the judgement means of the control unit C determines by means of the tension detector T that the tension of the yarn y exceeds the predetermined setting or range, exciting current to the armature winding is increased based on the command from the motor drive controlling means, thereby simultaneously increasing the rotation rates of the pair of the motors 30, 40. Subsequently, the feed rate of yarn y is increased by one pair of the pulleys 20*a*, 20*b* in order to decrease the tension of yarn y.

Similarly, if the judgement means of the control unit C determines that the tension of yarn y is smaller than the predetermined setting or range, exciting current to the armature winding is decreased based on the command from the motor drive controlling means, thereby simultaneously decreasing the rotation rates of the pair of the motors 30, 40. Subsequently, the feed rate of the yarn y is decreased by one pair of the pulleys 20*a*, 20*b* in order to increase the tension of the yarn y.

Figure 2:
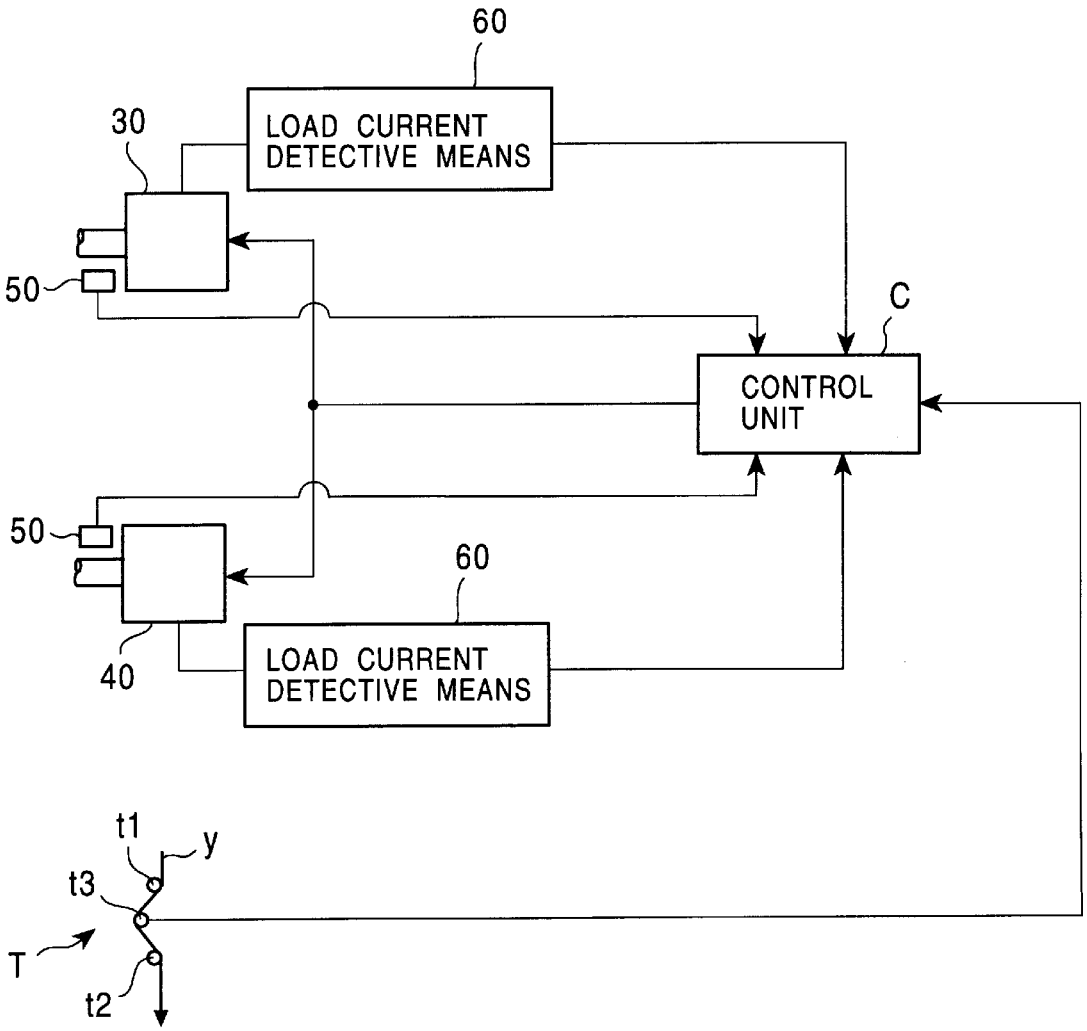
FIG. 2 is a control block diagram of an alternative embodiment of the yarn false twisting device of the present invention.

In the embodiment example illustrated in FIG. 2, the judgement means of the control unit C determines whether the tension of the yarn y detected by the tension detector T is outside or within the predetermined setting range, exactly the same as the embodiment example mentioned above. And, the amount of excited current to be supplied to the armature windings of the pair of motors 30, 40 is controlled from the command of the motor drive controlling means, which is based on the determination of the judgement means.

In this embodiment example, a motor rotation detecting means 50 (ball sensor) for detecting the rotation rate of the motors 30, 40 is installed in each motor 30, 40 in addition to the aforesaid arrangement.

Furthermore, a load current detecting means 60 for detecting load current to the armature winding of the motors 30, 40 is installed in each motor 30, 40. The detected rotation rate or load current of the motors 30, 40 is sent to the control unit C wherein the detected rotation rate or load current of the motors 30, 40 is judged to determine whether it is within or exceeds the predetermined setting range abnormally. If it is determined that the rotation rate or load current exceeds the predetermined setting range by an excessive amount, the yarn false twisting device is stopped or the control unit C gives a signal to the alarming means to activate the alarm. It is possible to install either or both of the aforesaid motor rotation detecting means 50 and the load current detecting means 60.

As described above, installing the motor rotation detecting means 50 or the load current detecting means 60 in each of the motors 30, 40 enables the accurate detection of the amount of wear on the bearing that supports the shafts to which the pulleys 10*a*, 10*b*, 20*a*, 20*b* are connected, or endless belts 10, 20.

Furthermore, it is possible to detect the breakage of the yarn y that is sandwiched between one pair of the endless belts 10, 20. For instance, if the yarn y breaks, the area over which endless belts are in contact with each other increases, thereby increasing load current. From increases in load current, the yarn breakage can be detected.

The control unit C calculates the target rotation rates applicable to each of the motors 30, 40 based on the tension detected by the tension detecting element, and provides separate feedback controls to each of the motors 30, 40 while detecting the rotation rate of each of the motors 30, 40 separately by means of the rotation detecting element so that each of the motors 30, 40 runs at the target rotation rate.

In the embodiment example described above, explanation is given by using a pair of the endless belts 10, 20 as the false twist application element that provides false twist to the yarn y. It is possible to use one pair of drums, in place of one pair of the endless belts 10, 20, as the false twist application element, and to let the drums sandwich yarn y and provide false twist to the yarn y, or to provide false twist via the friction disc method, wherein discs placed on three rotation axes that are positioned at each apex of a regular triangle (as viewed from the top) provide false twist to the yarn y. Application of one pair of endless belts as the false twist application element is therefore not to be considered restrictive.

Figure 4:
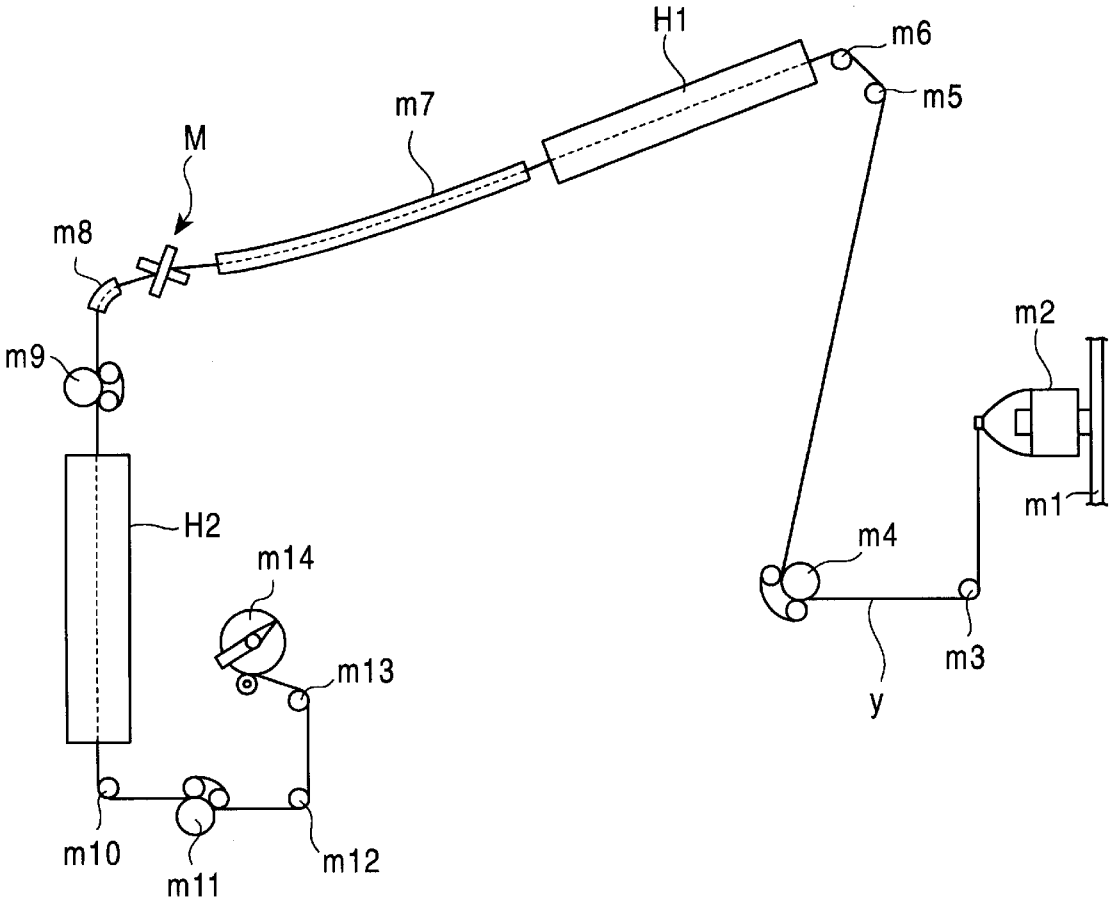
FIG. 4 is a schematic side view of a draw texturing machine, which is constructed with the yarn false twisting device of the present invention.
Figure 5:
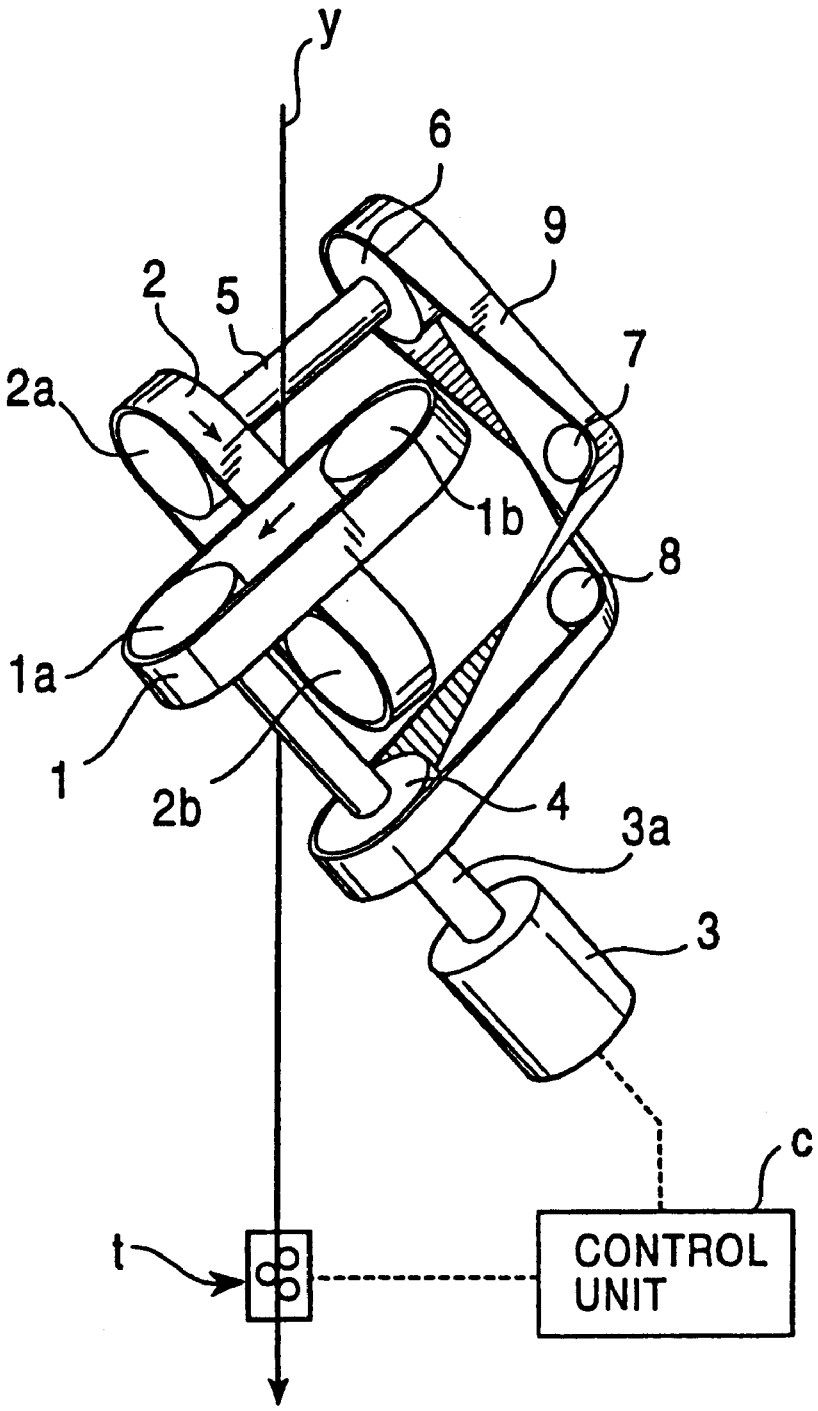
FIG. 5 PRIOR ART
FIG. 5 is a perspective side view of the conventional yarn false twisting device including control block.

An embodiment example wherein a yarn false twisting device as described above is adopted in a draw texturing machine, as illustrated in FIG. 4, is described below.

Reference character m1 refers to a creel stand. The yarn y, which is drawn out from a yarn supplying package m2, that is supported by the creel stand m1 at multiple points, is introduced into a first feed roller m4 through a proper guide m3. The yarn y is then guided by proper guides m5, m6, which are placed on a yarn inlet side of a first heater H1, and inserted into the first heater H1. The yarn y is fed through the first heater H1, brought onto a cooling element m7, and then given twist by the yarn false twisting device M described above. The yarn y is then brought into a second feed roller m9 through a proper guide m8. After coming out of the second feed roller m9, the yarn y is passed through a guide m10, a third feed roller m11 an oiling roller (not illustrated), and guides m12, m13, and finally wound around a take-up package m14.

The draw texturing machine described above includes a yarn breakage sensor, which detects breakage of the yarn, near the third feed roller m11. In the conventional draw texturing machine as illustrated in FIG. 4, once the yarn breakage sensor detects breakage, the cylinder (not illustrated), which keeps one pair of endless belts 1, 2 in contact with each other, is actuated to separate the pair of endless belts 1, 2 in order to minimize wear on the endless belts 1, 2.

With the present invention, however, a pair of the endless belts 10, 20 are separately driven by the separate motors 30, 40. Therefore, when the yarn breakage sensor detects breakage of the yarn merely stopping both motors 30, 40 simultaneously prevents wear on the endless belts 10, 20; there is no need to separate the pair of the endless belts 10, 20. This eliminates the need for such cylinder as installed in the conventional yarn false twisting device.

Additionally, when the running yarn into one pair of the endless belts 10, 20, is to stop, stoppage is obtained by simply separating the pair of the endless belts 10, 20 by manually moving a lever.

As the structure of the present invention has been explained, the present invention can be said to perform the following effects.

As the separate motors are installed for each drive shaft of the false twist application element, this eliminates a complex power transmission mechanism such as an endless belt or idler, thereby enabling the yarn false twisting device to be made more compact. In addition, since the rotation of each motor is controlled based on the tension of the yarn detected, the quality of false twisted yarn is improved. Furthermore, it is easy to change cross angles of false twisting components, including the false twist application element.

As the rotation detecting means that detect the rotation rate of each motor separately are provided, it is possible to accurately identify the amount of wear on the bearings of the false twist application element and on the false twist application element itself based on the rotation rates detected by the rotation detecting means. Additionally, it is possible to identify breakages of yarn from changes in the rotation rates.

The present invention is so constructed that the target rotation rates of each of said motors are calculated based on the tension of the yarn detected, and then each of said motors are separately controlled so that the rotation rate detected by each rotation detecting element is equal to the target rotation rate calculated. It is, therefore, possible to maintain each false twisting component at the respective correct target rotation rates, thereby further improving yarn quality.

When the yarn breakage is detected, each of the said motors is stopped. Therefore, it is possible to prevent wear on the false twist application element without providing a cylinder that moves and separates the false twist application element. In addition, if construction is performed so that the yarn breakage is detected from changes in the rotation rate of each motor or load current, there is no need to install an electro-optic yarn breakage sensor.

Using two brushless motors to drive the false twist application element enables the further downsizing of the yarn false twisting device.

Using two inner rotor motors to drive the false-twist application element reduces the inertia of rotating elements, including rotors, more than using the outer rotor motor does, thereby shortening response time to commands and decreasing controlling frequency. Therefore, each motor can be maintained accurately at its target rotation rate in accordance with the tension of the yarn detected, improving the quality of the yarn further.

We claim:

1. A yarn false twisting device comprising:

two endless belts arranged to apply a false twist to a yarn drawn across the crossing points of the belts;

separate driving shafts driving each of said belts;

separate drive motors driving each of said drive shafts;

a yarn tension detecting means operative to detect tension in the yarn drawn across said belts; and a controlling means operative to control the rotation rates of each of said drive motors in response to the yarn tension detected by said yarn tension detecting means.

2. A yarn false twisting device as recited in claim 1 wherein said yarn tension detecting means detects the respective rotation rates of said motors.

3. A yarn false twisting device as recited in claim 2 wherein the controlling means calculates target rotation rates applicable to each of said motors in accordance with the yarn tension detected by the yarn tension detecting means, and said controlling means being operative to control the said motors separately so that the rotation rates detected by respective rotation detecting means equal the target rotation rates.

4. A yarn false twisting device as recited in any one of claims 1, 2 or 3 including a yarn breakage detecting means which detects a breakage of the yarn, and the controlling means includes means operative to stop each of said motors when the occurrence of yarn breakage is detected.

5. A yarn false twisting device as recited in claim 4 including a load current detecting means which detects the respective load currents of said motors, and the yarn breakage detecting means detects the occurrence of yarn breakage based on the respective load currents of said motors detected by the load current detecting means.

6. A yarn false twisting device as recited in claim 1 wherein both of said motors are brushless motors.

7. A yarn false twisting device as recited in claim 6 wherein both of said motors are inner rotor motors wherein a rotor is positioned opposite the inner side of a stator.

8. A yarn false twisting device as recited in claim 1 wherein said controlling means includes means for maintaining the tension in the yarn within a predetermined setting range.

9. A yarn false twisting device as recited in claim 8 wherein said controlling means maintains the tension in the yarn at a predetermined setting value.

* * * * *